US008092148B2

(12) United States Patent
Seitz et al.

(10) Patent No.: US 8,092,148 B2
(45) Date of Patent: Jan. 10, 2012

(54) GAS TURBINE HAVING A PERIPHERAL RING SEGMENT INCLUDING A RECIRCULATION CHANNEL

(75) Inventors: Peter Seitz, Munich (DE); Roland Huttner, Jesenwang (DE); Karl-Heinz Dusel, Unterschleissheim (DE)

(73) Assignee: MTU Aero Engines GmbH, Munich (DE)

( * ) Notice: Subject to any disclaimer, the term of this patent is extended or adjusted under 35 U.S.C. 154(b) by 408 days.

(21) Appl. No.: 12/309,662

(22) PCT Filed: Jul. 18, 2007

(86) PCT No.: PCT/DE2007/001276

§ 371 (c)(1),
(2), (4) Date: Feb. 27, 2009

(87) PCT Pub. No.: WO2008/011864

PCT Pub. Date: Jan. 31, 2008

(65) Prior Publication Data

US 2009/0324384 A1 Dec. 31, 2009

(30) Foreign Application Priority Data

Jul. 26, 2006 (DE) ..... 10 2006 034 424

(51) Int. Cl.
*F04D 27/02* (2006.01)

(52) U.S. Cl. ..... 415/58.5; 415/58.7

(58) Field of Classification Search ..... 415/58.5, 415/58.7

See application file for complete search history.

(56) References Cited

U.S. PATENT DOCUMENTS

| | | | | |
|---|---|---|---|---|
| 3,053,694 | A | 9/1962 | Daunt et al. | 117/95 |
| 5,474,417 | A | 12/1995 | Privett et al. | |
| 6,264,425 | B1 | 7/2001 | Keller | |
| 6,537,020 | B2 | 3/2003 | Humhauser | |
| 6,913,436 | B2 * | 7/2005 | McMillan et al. | 415/9 |
| 7,347,144 | B2 | 3/2008 | Eisensteger et al. | |
| 2003/0152455 | A1 | 8/2003 | James | |
| 2007/0122269 | A1 | 5/2007 | Meier et al. | |

FOREIGN PATENT DOCUMENTS

| | | |
|---|---|---|
| EP | 0 497 574 | 9/1995 |
| EP | 0 719 908 | 7/1996 |
| EP | 0 751 280 | 1/1997 |
| EP | 0 992 656 | 4/2000 |
| EP | 1 149 985 | 10/2001 |
| EP | 1 286 022 | 2/2003 |
| GB | 504 214 | 4/1939 |
| WO | WO 2005/061855 | 7/2005 |

* cited by examiner

*Primary Examiner* — Jarrett Stark
*Assistant Examiner* — Nicholas Tobergte
(74) *Attorney, Agent, or Firm* — Davidson, Davidson & Kappel, LLC

(57) ABSTRACT

A gas turbine having at least one compressor, at least one combustion chamber, and at least one turbine, the or each compressor and/or the or each turbine having a rotor that includes rotor blades surrounded by a stationary housing, and a run-in coating being assigned to the housing is disclosed. The gas turbine includes at least one channel which is configured to apply a pressure prevailing on the high-pressure side of the blades of a rotor to a low-pressure side of the same in the area of a gap between the radially outer ends of the blades and the housing and thereby prevent a flow through the gap.

12 Claims, 1 Drawing Sheet

GAS TURBINE HAVING A PERIPHERAL RING SEGMENT INCLUDING A RECIRCULATION CHANNEL

This is a national phase of International Application No. PCT/DE2007/001276, filed Jul. 18, 2007, which claims priority to German Patent Application DE 10 2006 034 424.3, filed Jul. 26, 2006, the entire disclosure of which is hereby incorporated by reference herein.

BACKGROUND

The present invention relates to a gas turbine, in particular a gas-turbine aircraft engine having at least one compressor, at least one combustion chamber, and at least one turbine, the or each compressor and/or the or each turbine comprising a rotor that includes rotor blades surrounded by a stationary housing, and a run-in coating being assigned to the housing.

Gas turbines, in particular gas-turbine aircraft engines, typically have a plurality of rotating blades, as well as a plurality of stationary guide vanes in the area of a compressor and a turbine, the blades rotating together with a rotor, and the rotor blades as well as the guide vanes being surrounded by a stationary housing. In order to provide an enhanced performance, it is vitally important that all components and subsystems be optimized. These also include what are generally referred to as the sealing systems.

SUMMARY OF THE INVENTION

The process of maintaining a minimal gap between the rotating blades and the stationary housing of a high-pressure compressor of a gas turbine is especially problematic. Namely, high absolute temperatures, as well as high temperature gradients occur in high-pressure compressors. This complicates the task of maintaining the gap between the rotating blades and the stationary housing. This has to do, inter alia, with the fact that the cover bands, as are typically used for turbine blades, have been eliminated in the case of compressor blades. Turbine blades without cover bands are also known.

As just mentioned, the blades, in particular in the compressor, are not provided with a cover band. For that reason, the radially outer ends of the rotor blades are subjected to a direct frictional contact with the stationary housing when rubbing into the same. Such a rubbing of the rotor blade tips into the housing is caused by the manufacturing tolerances that result when a minimal radial gap is set. Since the frictional contact of the rotor blade tips against the same causes material to be ablated, the gap can become undesirably enlarged over the entire periphery of the housing and the rotor. To overcome this problem, it is already known from related art methods to hardface the ends of the rotor blades with a hard coating or with abrasive particles.

Another way to ensure that the tips, respectively the radially outer ends of the rotor blades do not become worn and to provide an optimized sealing action between the ends, respectively tips of the rotor blades and the stationary housing, is to coat the housing with what is generally referred to as a run-in coating.

When material is ablated from a run-in coating, the radial gap is not enlarged over the entire periphery, but rather, typically, only in a sickle shape. Housings having a run-in coating are generally known from the related art, the run-in coating typically being assigned to housing-side peripheral ring segments which are used as substrates for the run-in coating. Peripheral ring segments of this kind are also described as shrouds.

As explained above, even when a run-in coating is used, the gap between the tips, respectively radially outer ends of the rotor blades and the housing becomes enlarged, so that, under the related art, it is not possible to entirely prevent an aerodynamic flow through this gap from the high-pressure side of the rotor blades to a low-pressure side of the same. Accordingly, aerodynamic losses ensue within the gap. This reduces the efficiency of gas turbines.

Against this background, it is an object of the present invention to devise a novel gas turbine having reduced aerodynamic losses within the gap. The present invention provides a gas turbine having at least one compressor, at least one combustion chamber, and at least one turbine, the or each compressor and/or the or each turbine comprising a rotor that includes rotor blades surrounded by a stationary housing, and a run-in coating being assigned to the housing. In accordance with the present invention, the gas turbine has at least one channel which is configured to apply a pressure prevailing on the high-pressure side of the blades of a rotor to a low-pressure side of the same in the area of the gap between the radially outer ends of the rotor blades and the housing and thereby prevent a flow through the gap.

The present invention makes it possible to minimize aerodynamic gap losses in the area of the gap between the radially outer ends of the rotating rotor blades and the housing that forms during operation when the rotor blades run in against a run-in coating. The efficiency of gas turbines is hereby optimized.

The channel preferably extends, at least in portions thereof, within a housing-side peripheral ring segment used as a substrate for the run-in coating in such a way that, on the high-pressure side in the area of the peripheral ring segment, it leads into a flow channel and, on the low-pressure side in the area of the run-in coating, into the gap to be sealed.

BRIEF DESCRIPTION OF THE DRAWINGS

The present invention is described in greater detail in the following on the basis of exemplary embodiments, without being limited thereto. Reference is made to the drawing, whose.

DETAILED DESCRIPTION

Figure 1:
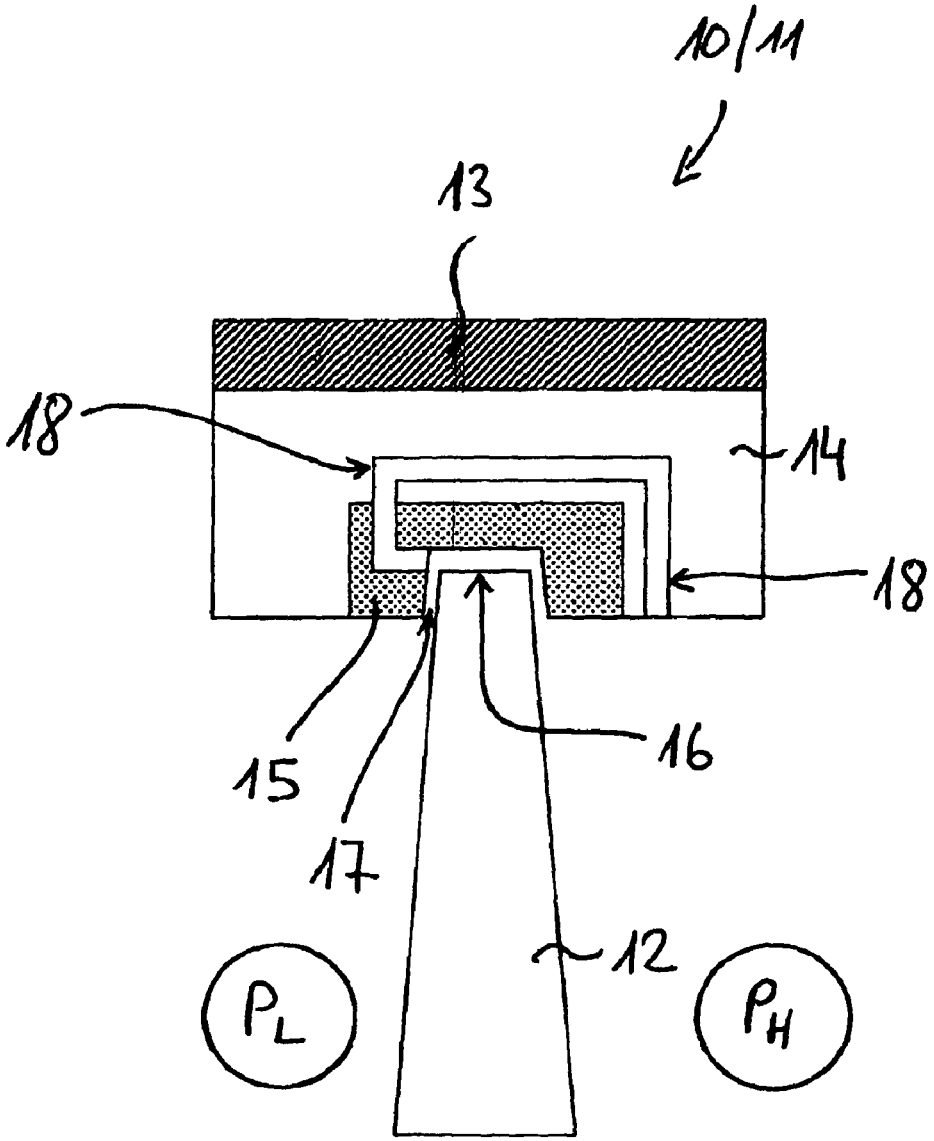
FIG. 1: shows a highly schematized cut-away portion of a gas turbine according to the present invention. The present invention is described in greater detail in the following with reference to FIG. 1.

FIG. 1 shows a highly schematized cut-away portion of a gas turbine 10 according to the present invention in the area of a high-pressure compressor 11, high-pressure compressor 11 having a rotating rotor, of which a rotor blade 12 is shown in FIG. 1. Blades 12 of the rotor of high-pressure compressor 11 are surrounded by a stationary housing 13, peripheral ring segments 14, which are used, inter alia, as substrates for a run-in coating 15, being assigned to housing 13.

In accordance with FIG. 1, during operation of the gas turbine, radially outer ends 16 of rotor blades 12 run in against run-in coating 15, so that a gap 17 forms between run-in coating 15 and radially outer ends 16 of the rotor blades. Through this gap 17, a leakage flow may form from the high-pressure side of rotor blades 12 to the low-pressure side of the same during operation of the gas turbine; in the representation of FIG. 1, the right side of rotor blades 12 being the high-pressure side in which pressure $P_H$ prevails, and the low-pressure side being the left side of the rotor blades where pressure $P_L$ prevails.

At this point, to prevent a leakage flow through gap 17, the present invention provides for gas turbine 10 to have at least one channel 18 which is configured to apply the pressure prevailing on the high-pressure side of rotor blades 12 to the low-pressure side of the same in the area of gap 17 to be sealed.

This results in approximately the same pressure prevailing in the area of gap 17 on the actual low-pressure side of the same as on the high-pressure side, thereby making it possible to effectively prevent a leakage flow through gap 17 and thus aerodynamic gap losses that are detrimental to the efficiency of the gas turbine.

Run-in coating 15 is a gas-permeable run-in coating which preferably has an open-cell structure. In particular, run-in coating 15 is formed from an open-cell metal foam.

Channel 18 illustrated in FIG. 1 extends, at least in portions thereof, within housing-side peripheral ring segment 14 used as a substrate for run-in coating 15; on the high-pressure side, where pressure $P_H$ prevails, channel 18 leading into a flow channel of high-pressure compressor 11 of gas turbine 10 in the area of peripheral ring segment 14. On the other hand, on the low-pressure side, where pressure $P_L$ prevails, channel 16 leads into gap 17 to be sealed, in the area of run-in coating 15.

A cross section of the or each channel 18 is preferably dimensioned in such a way that air possibly flowing through the particular channel acts as sealing air in the area of gap 17 to be sealed. Guide elements, such as deflectors or guide baffles, may be integrated into the or each channel 18 in order to optimally aerodynamically guide the sealing air flowing through channel 18.

The present invention is not limited to a use on high-pressure compressors. It may also be used on other types of compressors and on turbines.

What is claimed is:

1. A gas turbine comprising:

at least one compressor;

at least one combustion chamber; and at least one turbine, at least one of the at least one compressor and the least one turbine comprising a rotor and a stationary housing, the rotor including rotor blades, the stationary housing including a run-in coating and at least one channel, the stationary housing surrounding the rotor blades such that there is a gap between radially outer ends of the rotor blades and the stationary housing, the stationary housing further including a peripheral ring segment forming a substrate for the run-in coating;

wherein the at least one channel is configured to apply a pressure prevailing on a high-pressure side of the rotor blades to a low-pressure side of the rotor blades in an area of the gap to prevent a flow through the gap, at least a portion of the at least one channel extending within the peripheral ring, the at least one channel opening on the low-pressure side into the gap in a first area of the run-in coating at a low-pressure side opening, and opening on the high-pressure side in a second area of the peripheral ring segment outside of the gap at a high-pressure side opening.

2. The gas turbine as recited in claim 1 wherein the run-in coating is gas-permeable and has an open-cell structure.

3. The gas turbine as recited in claim 1 wherein the run-in coating is a metal foam.

4. The gas turbine as recited in claim 1 wherein a cross section of the at least one channel is dimensioned in such a way that air flowing through the at least one channel acts as sealing air in the area of the gap.

5. The gas turbine as recited in claim 1 wherein the gas turbine is an aircraft engine.

6. The gas turbine as recited in claim 1 wherein each blade of the blades has a radial outer edge extending axially between the low-pressure side and the high-pressure side.

7. The gas turbine as recited in claim 6 wherein the low-pressure side opening is spaced axially from the outer edge.

8. The gas turbine as recited in claim 6 wherein the high-pressure side opening is spaced axially from and not in contact with the run-in coating.

9. The gas turbine as recited in claim 1 wherein the high-pressure side opening is spaced axially from and not in contact with the run-in coating.

10. The gas turbine as recited in claim 1 wherein each blade of the blades has a radial outer edge extending axially between a low pressure side and a high pressure side and the run-in coating has a recess into which the radial outer edge extends.

11. The gas turbine as recited in claim 10 wherein the recess has a first radially extending surface on the low-pressure side, a second radially-extending surface on the high-pressure side and an axially-extending surface between the first and second radially-extending surfaces, the low-pressure side opening opening into the first-radially extending surface.

12. The gas turbine as recited in claim 1 wherein the channel at the low-pressure side opening extends toward the low-pressure side.

* * * * *